US005580692A

United States Patent [19]

Lofftus et al.

[11] Patent Number: 5,580,692

[45] Date of Patent: Dec. 3, 1996

[54] SOLVENT EXTRACTION IN LIMITED COALESCENCE PROCESSES

[75] Inventors: Kevin D. Lofftus, Rochester; Alexandra D. Bermel, Spencerport, both of N.Y.

[73] Assignee: Eastman Kodak Company, Rochester, N.Y.

[21] Appl. No.: 431,467

[22] Filed: May 1, 1995

Related U.S. Application Data

[63] Continuation of Ser. No. 888,064, May 26, 1992, abandoned.

[51] Int. Cl.[6] ..... G03G 5/00

[52] U.S. Cl. ..... 430/137; 430/110; 523/333; 523/338; 210/332; 210/702; 210/708

[58] Field of Search ..... 430/137; 523/333, 523/339; 210/702, 708, 332

[56] References Cited

U.S. PATENT DOCUMENTS

| | | | |
|---|---|---|---|
| 3,445,414 | 5/1969 | Glymph et al. | 430/137 |
| 3,830,733 | 8/1974 | Spivak et al. | 210/646 |
| 4,082,681 | 4/1978 | Takayama et al. | 430/137 |
| 4,108,786 | 8/1978 | Takayama et al. | 437/137 |
| 4,125,461 | 11/1978 | Li | 210/22 R |
| 4,758,492 | 7/1988 | Nair | 430/114 |
| 4,833,060 | 5/1989 | Nair et al. | 430/137 |
| 4,835,084 | 5/1989 | Nair et al. | 430/137 |
| 4,904,392 | 2/1990 | Dahlquist | 210/708 |
| 4,965,131 | 10/1990 | Nair et al. | 428/407 |
| 4,977,052 | 12/1990 | Mikami | 430/98 |

*Primary Examiner*—Samuel A. Acquah
*Attorney, Agent, or Firm*—Willard G. Montgomery; J. Jeffrey Hawley

[57] ABSTRACT

Powders suitable as electographic toner and/or carrier particles and other powders which utilize a liquid dispersant are produced by limited coalescence techniques. The dispersant is removed by mixing the suspension of coalesced droplets with a sufficient amount of an extracting liquid to cause the dispersant to diffuse out of the coalesced droplets into the extracting liquid.

19 Claims, No Drawings

SOLVENT EXTRACTION IN LIMITED COALESCENCE PROCESSES

This application is a continuation of application Ser. No. 07/888,064, filed May 26, 1992 now abandoned.

FIELD OF INVENTION

This invention relates to methods of preparing powders suitable as electrographic toner and carrier particles. More particularly, this invention relates to an improved method of preparing toner and/or carrier particles having controlled morphology and narrow particle size distribution, and other polymeric and inorganic powders with improved flow and handling properties.

BACKGROUND OF THE INVENTION

Particles useful as toner and/or carrier are prepared by numerous methods, probably the most primitive of which is grinding bulk polymer materials to a suitable particle size and/or particle size distribution. The disadvantages of this process are widely known. Initially, the particles are irregularly shaped after grinding and may not be suitable for their intended purpose. Secondly, some polymeric materials are not amenable to grinding due to their physical properties. Thirdly, the particle size distribution produced by grinding is broad.

In typical copying processes, toner and/or carrier particles are subject to electrostatic and other forces that affect the particles differently depending on their size. Therefore, in order to obtain high quality copies, it is preferred that toner particles have a controlled morphology and narrow size distribution. Past methods of attaining particles of the desired size and size distribution include sizing the toner particles by sieving or air classification. However, these methods result in significant product loss when used to obtain narrow particle size distributions. Recently, to avoid this expensive and time consuming process, new methods have been developed to produce particles having a narrow size distribution and controlled morphology.

One such method, referred to as "evaporation limited coalescence" is described in U.S. Pat. No. 4,833,060 to Nair, et al. ("Nair"). The limited coalescence technique described in Nair involves first forming a solution of a polymer in a solvent that is immiscible with water (along with any required addenda), and then suspending the polymer-solvent solution in water containing a promoter and a colliodal suspension stabilizer. The resulting suspension is subjected to high shear action to reduce the size of the polymer-solvent droplets. The shearing action is removed and the polymer-solvent droplets, with particles of stabilizer at their surface, coalesce to the extent allowed by the stabilizer to form coalesced polymer-solvent droplets. After the drop size has been determined by the limited coalescence, the solvent must be removed from the coalesced drops to form the solidified polymer particles which are then isolated from the suspension by filtration or other suitable means.

The Nair technique is referred herein to as a "conventional" limited coalescence process whereby the particles are formed from a water immiscible solution or dipsersion. In an "inverse" limited coalescence process, the particles are formed from a water or water-miscible solution or dispersion suspended in an immiscible hydrophobic liquid containing a colloidal suspension stabilizer. This inverse method is useful for producing particles having a narrow size distribution and controlled morphology from hydrophilic materials such as precursor to ferrites, ceramic powders, or water soluble polymers. Both techniques are useful to obtain powders with desirable handling properties (e.g., high powder flow, low dusting, etc.). Inverse limited coalescence is described in U.S. patent application Ser. No. 07/888,063 to Lofftus, entitled "INVERSE LIMITED COALESCENCE PROCESSES", filed May 26, 1992.

The Nair limited coalescence process has disadvantages, despite its ability to produce polymeric particles with controlled morphology and narrow size distribution. One key disadvantage is that the solvent is typically removed by evaporation. Evaporation of the solvent or dispersant, is a slow, time consuming process. In addition, many potential limited coalescence systems are not sufficiently robust to withstand the stirring and heating that is required to complete the evaporation process and solidify the coalesced droplets. The agitation and heat destablize the coalesced droplets before they are solidified, causing breakdown of the stabilized interface and agglomeration of the particles. Therefore, there continues to be a need for improved limited coalescence processes.

SUMMARY OF THE INVENTION

In accordance with the present invention, it has been discovered that the dispersant present in the coalesced polymer-solvent droplets of a conventional limited coalescence system or solids-dispersant droplets of an inverse limited coalescence system can be extracted by replacement or dilution of the suspending liquid. Unexpectedly, the Applicant has discovered that replacement or dilution of the suspending liquid will remove the dispersant without destabilizing the coalesced droplets and, in turn, altering the particle size and/or size distribution of the solidified particles.

The present invention encompasses a method of making particles having a controlled morphology and narrow particle size distribution. The present method includes first dispersing a polymer or other solid in a dispersant to form a dispersion phase. A suspending phase is formed by adding a colloidal stabilizer and, optionally, a promotor to a suspending liquid, which is substantially immiscible with the dispersant. Next, the suspending and dispersion phases are mixed together under high shear to form a suspension of small droplets of the discontinuous dispersion phase in the continuous suspending phase. The small droplets of dispersion phase are allowed to coalesce to form coalesced droplets having a defined size. The suspension of coalesced droplets is then mixed with a sufficient amount of an extracting liquid to remove the dispersant from the droplets and to form substantially solidified particles having a controlled morphology and narrow size distribution.

The extracting liquid of the present method can be the same liquid as the suspending liquid, a liquid miscible with the suspending liquid that has a mutual miscibility with the dispersant, or a cosolvent solution which is miscible in both the dispersant and the suspending liquid. In a preferred embodiment of the present invention, the small droplets of dispersion phase are allowed to coalesce to a larger size at which substantially no further coalescence can occur before they are mixed with the extracting liquid. The method of the present invention is particularly useful to produce solidified polymeric particles suitable for use as a polymeric toner and/or a carrier in electrographic processes.

The method of the present invention produces polymeric particles exhibiting controlled morphology and particle size distribution. The present method has the advantage of greatly reducing the time required to remove the dispersant from the coalesced droplets by eliminating the need to evaporate the dispersant. In addition, this advantage allows processing of less robust droplets that could not ordinarily withstand the heat or agitation required to evaporate the dispersant.

DETAILED DESCRIPTION OF THE INVENTION

In accordance with the present invention, a method of making particles having a controlled morphology and/or narrow size distribution is disclosed. The process of this invention is useful in preparing a variety of particles having a narrow size distribution. These particles are useful for making electrographic toners and carriers, ceramic powders, matte materials, bead spread layers, drug loaded beads, ion exchange resins, and other materials that require small particles of narrow size distribution and/or controlled morphology. The present method will be described below in detail relative to particles formed for use as electrographic toner and/or carrier.

The solid materials that compose the particles to be formed are first dispersed and/or dissolved in a dispersant which is immiscible with the suspending liquid to be used. For toners, various toner addenda (e.g., colorant, charge control agent) can be added to the toner polymer either before or during this dispersion step. Likewise, if the particles are to be used as carrier particles, precursors for forming magnetic materials and binders for ferrites such as those disclosed in U.S. Pat. Nos. 4,546,060, 4,345,014, 5,061,586, and 4,764,445 can be dispersed in water.

The quantity of dispersant is important in that as the amount of dispersant is increased, the resultant size of the particles prepared under given agitation conditions will decrease. Generally, higher concentrations of solids in the dispersant produce larger particle size powder particles having a lower degree of shrinkage than those produced by lower concentrations of solids in the same dispersant. The concentration of the solid materials in the dispersant should be from about 1 to about 80 and preferably from about 2 to about 65 weight percent. When preparing electrographic toner particles, the concentration of polymer in dispersant is generally maintained at about 10 to about 35 weight percent ("wt %") for a resin having a number average molecular weight of 10,000 and a weight average molecular weight of 200,000. The concentration of solids is generally maintained at about 30 to 65 wt % in dispersion used in making ferrites for electrographic carriers.

The dispersion of polymer in dispersant (the "dispersion phase" of the system) is introduced into a suspending liquid which is substantially immiscible with the dispersant and contains a colloidal stabilizer. The weight ratio of dispersion phase to suspending liquid (the "continuous phase" of the system) must be sufficiently small to cause the dispersion phase to form a discontinuous phase within a continuous suspending phase upon shear mixing. However, the weight ratio should be maintained at a high level so that the specific process capacity (the unit weight of particles produced per unit volume of process equipment) is optimized. Another objective of maintaining a high weight ratio of dispersion phase is to increase the collision rate of very small droplets produced by shearing relative to larger droplets so that a narrow size distribution may be obtained. For low density dispersions such as those used for making toners, a weight ratio of dispersant to suspending liquid in the range from about 0.1 to about 0.4, preferably from about 0.25 to about 0.35, is generally maintained. High density dispersions, such as those used for making carriers, generally are used at a weight ratio of about 0.3 to about 0.65, preferably from about 0.4 to about 0.6.

The stabilizer serves to surround the dispersion phase droplets during the subsequent shear mixing of the dispersion phase and the suspending phase. The stabilizer limits the coalescence the dispersion phase droplets can undergo upon removal of the shearing force. To achieve this effect, it is generally desired to control the pH of the system to regulate the charge and hydrophilicity of ionizable stabilizers. The pH should be maintained at about the $pk_a$ to $pk_a+5$, preferably $pk_a+1$ to $pk_a+4$, for colloids with an acid group. Likewise, the pH should be maintained at $14-pk_b$ to $9-pk_b$, preferably $13-pk_b$ to $10-pk_b$ for colliods having basic groups. Amphoteric colliods may be used in a pH range of 5 pH units either side of the stabilizer's isoelectric point, preferably 1 to 4 pH units from the isoelectric point. For silica, the isoelectric point is about 2 and the pH is generally maintained between at a value of from about 2 to about 7, preferably from about 3 to 6 and most preferably 4. $pk_a$ is a value representing the extent of dissociation of a stabilizer's acid group and is defined by the base 10 logarithm of the inverse of the equilibrium constant of the acid dissociation. Likewise, $pk_b$ is a value representing the extent of dissociation of a stabilizer's base group and is defined by the base 10 logarithm of the inverse of the equilibrium constant of the base dissociation. The isoelectric point is the pH value where all the charges on the stabilizer added together are net neutral.

Suitable concentrations of stabilizer are, generally, from about 1.0 to 70 g per 100 g of solids in the dispersion phase, preferably from about 2 to 35 g per 100 g of solids for silica stabilizers. Latex stabilizers are generally used in concentrations from about 0.1 to 10 g per 100 g of solids in the dispersion phase, preferably from about 0.5 to 5.0 g per 100 g of solids in the dispersion phase. Microgel stabilizers are generally used in concentrations from about 0.5 to 50 g per 100 g of solids in the dispersion phase, preferably 1.0 to 25 g per 100 g of solids in the dispersion phase. Further details regarding the use of stabilizers in limited coalescence processes can be found in U.S. Pat. Nos. 4,965,131 to Nair, et al., 4,833,060 to Nair, et al., and 4,758,492 to Nair, the disclosures of which are hereby incorporated by reference. The size of the coalesced droplets ultimately formed depends on the amount of the stabilizer employed. As the quantity of stabilizer added to the system increases, the size of the coalesced droplets will generally decrease.

Optionally, depending on the stabilizer used, a promoter can also be added to the continuous phase. If used, the promoter should be present in an amount of about 1 to about 10 percent and preferably from about 2 to about 7 percent based on the weight of the dispersion phase.

The dispersion phase is mixed with the continuous phase under high shear agitation. The shearing conditions must be great enough to break the dispersion phase into droplets substantially smaller than the droplets formed after limited coalescence has occurred. Additionally, the temperature must be maintained sufficiently low to prevent heating and local cavitation in the shear zone.

During this shearing step, the dispersion phase droplets are dispersed and reduced in size in the suspending liquid in a high shear agitation zone and, upon exiting this zone, a suspension of small dispersion phase droplets in the suspending liquid is formed. Each of the small dispersion phase droplets are surrounded by stabilizer particles which limit and control both the size and size distribution of the small, dispersion phase droplets as they coalesce. Preferably, the small droplets are allowed to coalesce to a larger size at which substantially no further coalescence can occur, as controlled by the stabilizer particles present on the surface of the small droplets. While any high shear type agitation device is applicable to the process of this invention, it is preferred that the dispersion phase be introduced into the suspending liquid in a microfluidizer such as Model No. 110F (sold by Microfluidics Manufacturing, 90 Oak Street, Newton, Mass. 02164).

After the droplets of dispersion phase have been subjected to the high shear agitation, the dispersant must be removed from the coalesced droplets. In accordance with the present invention, the suspension is mixed with a sufficient amount of an extracting liquid to cause the dispersant to diffuse from the coalesced droplets into the extracting liquid. Enough dispersant must be removed at this step substantially to solidify the coalesced droplets. That is, the viscosity of the coalesced droplets must be raised sufficiently to prevent agglomeration of the solidified particles during subsequent isolation steps. Gentle agitation should be maintained during the extraction process so that the droplets are continually exposed to fresh extracting liquid so that the dispersant continues to diffuse into the extracting liquid. The time required for the dispersant to diffuse out of the droplet increases as: (1) the droplet size increases, (2) the porosity of the stabilizer decreases, and (3) the concentration of the dispersant dissolved in the extracting liquid increases.

The amount of dispersant removed is dependent on the subsequent isolation steps. For example, if the solidified particles are isolated from the suspension by filtration, a higher degree of solidification will be required to increase the "robustness" of the coalesced droplets (i.e., resistence to agglomeration or coalescence past the limit as controlled by the stabilizer) due to the mechanical stress of filtration. On the other hand, if the solidified particles are separated by sedimentation, the particles need not be as thoroughly solidified.

The extraction can be performed in a variety of ways. The exact method of performing the extraction step will depend on the goals of the limited coalescence process as well as on the choice of materials in the limited coalescence system. Initially, sufficient extracting liquid to remove all the dispersant required can be added as a single batch extraction. A single batch extraction is useful when the extracting liquid and the dispersant have relatively high mutual miscibilities, when the dispersion phase droplets are less robust, and when relatively small scale production is undertaken.

Another mode of extraction is by multiple stage batch extraction. Multiple stage extraction is advantageous when a large amount of extracting liquid is required to complete the extraction step (e.g., when the extracting liquid and the dispersant have relatively low mutual miscibilities or in relatively large scale production). Multiple stage extraction requires droplets with a higher degree of robustness because a separation step (e.g., filtration or sedimentation) must be performed after each stage. Multiple stage extraction can be performed using either the same or different extracting liquids in each step. For example, it may be advantageous to use a different extracting liquid after the particles have become more robust due to the removal of dispersant in previous stages. A cosolvent or a new, more miscible, extracting liquid can be used to speed up extraction without destabilizing the dispersion phase droplets. This method is very useful when the suspending liquid or the initial extracting liquid is difficult to remove by evaporation.

A third way of performing the extraction step is by continuous extraction. Continuous extraction is performed, for example, by providing a continuous stream of extracting liquid that mixes with a continuous stream of the suspension. The resulting mixture can be deposited directly to the separation apparatus (e.g., filter). This method dispenses with the need of extracting dispersant in separate, discrete batches and is useful in very large scale production.

The various methods of performing the extraction step can be performed in any combination to suit the goals of the particular limited coalescence process. In addition, the extraction methods can also be used to perform an initial, bulk removal of dispersant with the remaining dispersant removed by conventional means such as evaporating, vacuum drying, or oven drying.

As stated above, the extracting liquid can be the same as the suspending liquid, a liquid miscible with the suspending liquid that has a mutual miscibility with the dispersant, or a cosolvent solution which is miscible in both the dispersant and the suspending liquid. Preferably, the extracting liquid and the suspending liquid are the same to simplify waste disposal and separation. If a cosolvent is used, it preferably exhibits a hydrophilic nature between that of the dispersant and suspending liquid. If the extracting liquid is the same as the suspending liquid, the liquid used must exhibit some mutual miscibility with the dispersant. As noted above, preferably, the suspending liquid and the dispersant are immiscible enough to promote good limited coalescence (i.e., form two sufficiently immiscible phases such that the stabilizer will migrate to the interface between the dispersion phase and suspending liquid), but are as miscible as possible to promote diffusion of the dispersant from the coalesced drops upon addition of the extracting liquid.

The amount of extracting liquid that must be added to remove a given amount of dispersant from the coalesced droplets depends on the mutual miscibility of the extracting liquid and the dispersant, the rate of diffusion of the dispersant from the droplets to the extracting liquid, and the number of steps in the extraction process. Mutual miscibility data for various useful substituents such as those described herein is available in the literature or can be obtained by experimental procedures known in the art. The miscibility for the dispersant in the suspending liquid should be 0.5 to 25, preferably 1 to 10, wt %. The dispersant should be at least 2, preferably, 5 wt % miscible in extracting liquid.

Next, should it be desired, the stabilizer can be removed from the surface of the particles by any suitable technique. Silica stabilizers can be dissolved in hydrogen fluoride or other fluoride ion or, preferably, by adding an alkaline agent such as potassium hydroxide to the aqueous phase containing the particles. Many inorganic stabilizers can be dissolved in acid solutions. Organic stabilizers used in producing ceramic powders can be removed by combustion. After removing the stabilizer, the particles can be recovered by filtration and finally washed with water or other agents to remove any desired impurities from the surface of the particles.

For conventional limited coalescence processes, any suitable water-immiscible dispersant which will disperse the polymer or other solid and is also substantially immiscible with the suspending liquid can be used in the practice of this invention. For the purposes of this invention, "dispersion" includes both suspensions and solutions of the polymer or other solid. For example, chloromethane, dichloromethane, ethyl acetate, vinyl chloride, methylethyl ketone, trichloromethane, carbon tetrachloride, ethylene chloride, trichloroethane, toluene, xylene, cyclohexanone, 2-nitropropane and the like are all useful dispersants. Particularly useful dispersants include ethyl acetate and dichloromethane.

Any suitable suspending liquid which is substantially immiscible with the dispersant can be used in the practice of the present method. Water is a particularly useful suspending liquid. Other exemplary water-miscible suspending liquids include lower alcohols (e.g., methanol, ethanol, and propanol), aromatic alcohols (e.g., phenyl alcohol, benzyl alcohol), ketones (e.g., acetone), ethers (e.g., tetrahydrofuran and dioxane), amides (e.g., N,N-dimethylformamide), amines (e.g., morpholine and pyrrolidone), sulfoxides (e.g., dimethyl-sulfoxide), glycerol, ethylene glycol, and other polar suspending liquids. These suspending liquids can be used singly or as mixtures of two or more.

The method of the present invention is applicable to producing particles with a controlled morphology and narrow size distribution from any material that is capable of being uniformly dispersed in a dispersant. The present method is particularly useful to form toner particles from polymers capable of dissolution in water-immiscible solvents (i.e., dispersants). Exemplary hydrophobic polymers include olefin homopolymers and copolymers, such as polyethylene, polypropylene, polyisobutylene, and polyisopentylene; polyfluoroolefins, such as polytetraflouroethylene and polytrifluorochloroethylene; polyamides, such as polyhexamethylene adipamide, polyhexamethylene sebacamide, and polycaprolactam; acrylic resins, such as polymethylmethacrylate, polymethylacrylate, polyethylmethacrylate, and styrene-methylemethacrylate; ethylene-methyl acrylate copolymers, ethylene-ethyl acrylate copolymers, ethylene-ethyl acrylate copolymers, ethylene-ethyl methacrylate copolymers, polystyrene and copolymers of styrene thereof with unsaturated monomers mentioned above, cellulose derivatives, such as cellulose acetate, cellulose acetate butyrate, cellulose propionate, cellulose acetate propionate, and ethyl cellulose; polyesters, such as polycarbonates; polyvinyl resins, such as polyvinyl chloride, copolymers of vinyl chloride and vinyl acetate, and polyvinyl butyral, polyvinyl acetal, ethylene-vinyl acetate copolymers, ethylene-vinyl alcohol copolymers, and ethylene-allyl copolymers, such as ethylene-allyl alcohol copolymers, ethylene-allyl acetate copolymers, ethylene-allyl acetone copolymers, ethylene-allyl benzene copolymers ethylene-allyl ether copolymers, and ethylene-acrylic copolymers; and polyoxymethylene, polycondensation polymers, such as polyesters, polyurethanes, polyamides, polycarbonates and the like.

The present method can also be used with inverse limited coalescence systems (i.e., a hydrophilic substance dispersed in a water-miscible dispersant and mixed with a water-immiscible suspending liquid) such as described in copending U.S. patent application Ser. No. 07/888,063, to Lofftus, entitled, "INVERSE LIMITED COALESCENCE PROCESS". The water-miscible and water-immiscible liquids disclosed above are equally useful in inverse limited coalescence systems. Inverse limited coalescence methods are applicable to hydrophilic substances such as oxides, carbonates, sulfates, phosphates, tungstates, molybdates, titanates, hydroxides, inorganic and organic water soluble salts, organic and organometallic water soluble compounds, and water soluble polymers.

Dispersants especially useful in inverse limited coalescence systems include water, methanol, benzyl alcohol, N,N-dimethyl formamide, glycerol, and ethylene glycol.

Water-immiscible suspending liquids especially useful in inverse limited coalescence systems include normal, secondary, tertiary, and cyclic alcohols containing at least four carbon atoms, aromatic alcohols, ketones having three or more carbon atoms, halogenated solvents, and various esters.

The extracting liquid used in the present method can be the same as the suspending liquid (provided it exhibits some mutual miscibility with the dispersant), another liquid which is miscible with the suspending liquid and in which the dispersant has at least 2, preferably 5, wt % miscibility, or a cosolvent having a hydrophilic nature between that of the dispersant and suspending liquid. Any of the water-miscible or water-immiscible substances listed above as useful dispersants and/or suspending agents can be used as the extracting liquid provided it exhibits sufficient mutual miscibility with the dispersant. The extracting liquid must be sufficiently miscible to promote diffusion while not disrupting the stability of the coalesced droplets before they solidify.

A cosolvent can be used when the dispersant and the suspending liquid are not sufficiently miscible to allow diffusion of the dispersant into the suspending liquid or when sufficient extraction of solvent has occurred to prevent destabilization of the dispersion phase droplets by the cosolvent. The choice of cosolvent will depend on the other constituents of the limited coalescence system. Exemplary cosolvents include SOLVESSO 100™, (a mixture of xylenes having a boiling point between 154° and 174° C., available from Exxon, Inc.), butyl alcohol, methyl alcohol, methylethyl ketone, ethyl alcohol, and acetone. A particularly useful cosolvent is methanol because it is least likely to destabilize the coalesced dispersion phase droplets.

A particularly preferred conventional limited coalescence system includes ethyl acetate as the dispersant and water as both the suspending liquid and the extracting liquid.

A particularly preferred inverse limited coalescence system includes water as the dispersant, benzyl alcohol as the suspending liquid, and a combination of benzyl alcohol and isopropyl alcohol as the extracting liquid.

The stabilizers useful in evaporation limited coalescence include silica, metal oxides (e.g., alumina), barium sulfate, barium carbonate, calcium, calcium sulfate, and carbonate calcium phosphate, the latex-based copolymer stabilizers disclosed in U.S. Pat. No. 4,965,131 to Nair et al. and the microgels disclosed in U.S. Pat. No. 4,758,492 to Nair. If a latex-based copolymer stabilizer is used, the stabilizer need not be removed from the particles. Preferred stabilizers include the silica-based stabilizers disclosed in U.S. Pat. No. 4,833,060 to Nair, etal. A particularly useful silica stabilizer is sold by DuPont under the name LUDOX TM™.

The particles used as a stabilizer generally have dimensions from about 0.001 μm to about 1 μm, preferably from about 5 to 35 nanometers and most preferably from about 10–25 nanometers. The size and concentration of these particles controls and predetermines the size of the final particle.

If needed, any suitable promoter which is soluble in the suspending liquid and affects the hydrophilic/hydrophobic balance of the stabilizer in the suspension medium may be employed. Exemplary promoters include sulfonated polystyrenes, alginates, carboxymethyl cellulose, tetramethyl ammonium hydroxide or chloride, diethylaminoethylmethacrylate, water-soluble complex resinous amine condensation products such as the water soluble condensation products of diethanol amine and adipic acid (a particularly suitable promoter of this type is poly(adipic acid-co-methylaminoethanol)), water-soluble condensation products of ethylene oxide, urea and formaldehyde and polyethyleneimine. Other useful promoters include gelatin, glue, casein, albumin, gluten and the like. Nonionic materials such as methoxy cellulose may be used. Generally, the promoter is used in amounts of from about at least 0.2, preferably 0.25 to about 0.6, parts per 100 parts of suspending liquid. As described in U.S. Pat. No. 4,965,131, if a latex-based copolymer stabilizer is used, no promoter is required.

Particles having an average size of from 0.05 μm to 100 μm and preferably from 0.1 μm to 60 μm may be prepared in accordance with the present method. Further details relating to evaporation limited coalescence processes are disclosed in U.S. Pat. Nos. 4,833,060 to Nair et al., and 4,965,131 to Nair et al., the disclosures of which are hereby incorporated by reference.

The various addenda generally present in electrographic toner that can be added to the polymer prior to dispersion or ill the dispersion itself include colorant selected from a wide variety of dyes and pigments such as disclosed for example, in U.S. Pat. No. 31,072. A particularly useful colorant for toners used in black-and-white electrographic copying machines is carbon black. Colorants are typically used in an amount of from about 1 to about 30 percent by weight based on the weight of the toner. Preferably, from about 1 to 8 percent by weight of colorant is employed.

Other addenda can be included such as, for example, charge control agents. Suitable charge control agents are disclosed for example in U.S. Pat. Nos. 3,893,935; 4,079,014; 4,323,634 and British Patent Nos. 1,501,065 and 1,420,839. Charge control agents are generally employed in small quantities such as, from about 0.1 to about 3 wt % and preferably from about 0.2 to about 1.5 wt % based on the weight of the toner.

Powders suitable as carrier particles for use in the development of electrographic images can also be prepared in accordance with this invention. If carrier particles are desired, magnetic materials such as those disclosed in U.S. Pat. Nos. 4,546,060 or 4,345,014 can be included in the dispersion phase droplets in conventional limited coalescence processes. Precursors that form magnetic materials (e.g., ferric oxide and strontium carbonate with gum arabic as a binder) useful as carrier particles can be manufactured in inverse limited coalescence processes.

The present invention will now be described in detail by reference to the following Examples that by no means are intended to limit the scope of the invention.

EXAMPLES

Example 1

A limited coalescence, suspension consisting of a dispersion phase containing 75g of styrene butylacrylate copolymer dissolved in 300 g of ethyl acetate and a suspension phase consisting of 1125 ml of pH 4 buffer, 0.8 ml of LUDOX TM™ silica stabilizer, and 0.27 ml of a 10 wt % solution of poly(adipic acid-co-methylaminoethanol) promoter was prepared by mixing with a lab mixer. This suspension was added to 6000 ml of chilled water with stirring immediately after mixing. Stirring was soon discontinued and the polymer beads were allowed to settle for one hour. The effluent was decanted, and the beads were filtered, rinsed, washed with 450 ml of 10 wt % potassium hydroxide solution overnight, filtered, rinsed, and dried.

A powder of spherical polymer beads having a narrow particle size distribution with a mean particle size of 57 μm was produced. The ethyl acetate dispersant was removed in about one hour. It would be expected to take 4 to 24 hours to remove a like amount ethyl acetate by evaporation. Additionally, little agglomeration due to suspension destabilization was observed.

Example 2

A dispersion phase containing 86 g of $Fe_2O_3$, 14 of $SrCO_3$, 4 g of gum arabic, 0.33 ml of DAXAD 32™ (a polymethacrylic acid solution available from W.R. Grace & Co., Lexington, Mass.) and 75 g of water was milled for 24 hours. The pH of the dispersion phase was reduced to a pH of 7.0 by the addition of 0.25 ml acetic acid, followed by milling for ten minutes. A suspending liquid containing 186 ml of benzyl alcohol and 14 ml of water was prepared by adding 201 ml of a 10.7 wt % suspension of a latex stabilizer having the composition 24 wt % styrene, 38 wt % n-butyl acrylate, 30 wt % 2-hydroxyethyl methacrylate, 5 wt % methacrylic acid, and 3 wt % ethylene glycol dimethacrylate. The stabilizer particles had an average particle size of about 60 nm. The pH of the suspending liquid was increased slightly with 0.05 ml of 58 wt % $NH_4OH$ while mixing in a lab mixer. The dispersion phase and suspending liquid were mixed under high shear and this suspension was added to 800 ml of benzyl alcohol and stirred for a short period of time. The benzyl alcohol was removed by decantation after the particles had settled followed by repeated cycles of resuspension of the particles in isopropyl alcohol, sedimentation, and decantation. The residual alcohol was removed by evaporation. The solidified particles were fired at 1200° C. for 10 hours to produce spherical ferrite particles useful as an electrographic carrier.

Example 3

A 25 g dispersion phase of 15 wt % styrene butylacrylate copolymer dissolved in ethyl acetate and a suspending liquid including of 75 ml of pH 10 buffer, 4.6 ml of a 3 wt % latex suspension having the composition 8 wt % styrene, 50 wt % n-butyl acrylate, 30 wt % 2-hydroxyethyl methacrylate, 5 wt % methacrylic acid, and 7 wt % ethylene glycol dimethacrylate (average particle size of 27 nm) chilled to 4° C. were prepared. The dispersion phase and the suspending liquid were mixed in an ice bath with a lab mixer and homogenized in a Microfluidizer (model 110F from Microfluidics Crop.) directly into an extraction fluid consisting of 100 ml of water and 50 ml of methanol that was chilled to 7° C. This mixture was stirred in an ice bath for 4 minutes and half of the mixture was placed on a filter. The filtration rate of this sample slowly decreased and the particles adhered to the filter paper after drying. The other half was stirred for an additional 11 minutes before filtration. This sample filtered rapidly and did not adhere to the filter paper when dry.

The particle size distribution of the particles was evaluated by determining coarseness and fineness indices. The coarseness index is defined as the ratio of the 84th volume percentile diameter to the volume median diameter of the particles. The fineness index is defined as the ratio of the number mean diameter to the 16th number percentile diameter of the particles. Grinding typically produces particles with indices greater than 2 and classification can be used to attain indices in the range of 1.2 to 1.8 from the ground particles.

The particles formed according to the above procedure were spherical with an average particle size of 3.3 μm. The particles had a coarseness index of 1.17 and a fineness index of 1.14. Sufficient ethyl acetate was extracted to substantially solidify the particles within about 15 minutes. It would be expected that the volume of extracting liquid required would be much greater in the absence of a cosolvent to remove a like quantity of dispersant.

Example 4

A dispersion phase containing 36.9 g of $BaSO_4$7.5 g of $(NH_4)_2SO_4$, 15.15 g of $SrCl_2$, 3 g of gum arabic, 0.5 ml of DAXAD 32™, and 125 g of decarbonated water and a suspending liquid including 465 ml of benzyl alcohol, 35 ml of water, and 15 ml of a 3 wt % latex stabilizer suspension having the composition 24 wt % styrene, 38 wt % n-butyl acrylate, 30 wt % 2-hydroxyethyl methacrylate, 5 wt % methacrylic acid, and 3 wt % ethylene glycol dimethacrylate were prepared. The dispersion phase and the suspending liquid were mixed in a lab mixer for 1 minute. The suspension was then added to 2000 ml of benzyl alcohol with stirring. Rapid sedimentation occurred due to reversible agglomeration of the particles allowing decantation and benzyl alcohol removal as described in Example 2. Residual amounts of benzyl alcohol were removed by repeated cycles of resuspension of the particles in methylene chloride, sedimentation, and decantation. The residual methylene chloride was removed by evaporation under a loose cover to minimize the condensation of ambient moisture.

Spherical particles were formed with a narrow particle size distribution and a mean particle size of about 5.0 μm.

Example 5

A 15 wt % styrene butylacrylate copolymer (73.2 g) and a phthalocyanine pigment dispersion (3.4 g) containing 90 wt % pigment and 10 wt % styrene butylacrylate copolymer was dissolved at concentration of 16.6 wt % solids in ethyl acetate to form a dispersion phase. A suspending liquid containing 225 ml of pH 10 buffer, 10 ml of a 3 wt % latex suspension having a composition 8 wt % styrene, 50 wt % n-butyl acrylate, 30 wt % 2-hydroxyethyl methacrylate, 5 wt % methacrylic acid, and 7 wt % ethylene glycol dimethacrylate (average particle size of 27 nm) chilled to 7° C. was prepared. The dispersion phase and the suspending liquid were mixed in an ice bath with a lab mixer followed by homogenizing in a Microfluidizer. The glow rate of the homogenizer output was about 400 ml per minute and the output was fed tangentially into a mixing chamber into which 2000 ml per minute of cold tap water (12° C.) was also fed tangentially. The resulting suspension was fed through a screen directly onto a filter. The particles were washed three times to remove pH buffer salts by resuspending in about 300 ml of water, stirring vigorously for 15 minutes, and filtering.

Spherical particles were formed have a mean diameter of about 4.8 μm with a coarseness index of 1.17 and a fineness index of 1.14, indicating a narrow particle size distribution.

Example 5 illustrates a method of semicontinuous production of particles suitable as electrographic toners whereby the total residence time before drying was reduced to about one hour.

Example 6

A dispersion phase including 46.4 g $Fe_2O_3$, 3.6 g $SrCO_3$, 4 g gum arabic, 2.5 g of polymethacrylic acid, 0.16 ml of DAXAD 32™, and 105 g methanol was mixed with a suspending liquid including 400 ml of ISOPAR G™ to form a suspension. Microgel stabilizer (8.0 ml) having a composition of 81 wt % isobutyl methacrylate, 15 wt % ethylhexyl methacrylate, and 4 wt % divinyl benzene was predispersed in a concentration of 11 wt % in SOLVESSO 100™. The colloidal dispersion of stabilizer was then added to the suspension. The suspension was allowed to settle and the excess liquid was decanted. The dispersant was extracted in stages by mixing with an extracting liquid comprising 275 ml of ISOPAR G™ (a mixture of isoparaffins having a boiling point between 159° C. and 174° C. available from Exxon Corp.) and 25 ml of SOLVESSO 100™, allowing the particles to settle, and separating the resultant particles by decanting. This step was repeated twice and then a final stage of extraction was attempted with an extracting liquid comprising 250 ml of ISOPAR G™ and 50 ml of SOLVESSO 100™. The final stage of extraction destabilized the particles due to the removal of the stabilizer by the cosolvent. The resulting dispersion phase was resuspended in 300 ml of ISOPAR G™ and 9 ml of the stabilizer dispersion. The resulting suspension was extracted using 5 stages with an extracting liquid including 275 ml of ISOPAR G™ and 25 ml of SOLVESSO 100™. The residual extracting liquid was removed by evaporation. The particles formed were spherical and had a narrow particle size distribution.

Although the invention has been described in detail for the purpose of illustration, it is understood that such detail is solely for that purpose, and variations can be made therein by those skilled in the art without departing from the spirit and scope of the invention which is defined by the following claims.

What is claimed is:

1. A method of making particles having a controlled morphology and narrow particle size distribution, comprising the steps of:

dispersing a quantity of a material in a dispersant to form a dispersion phase;

blending said dispersion phase with a suspending liquid under high shear to produce a suspension of dispersion phase droplets in said suspending liquid, wherein said suspending liquid and said dispersant are immiscible enough to form two phases and said suspension contains a stabilizer which controls said dispersion phase droplets' coalescence;

allowing said dispersion phase droplets in said suspension to coalesce to a larger size at which substantially no further coalescence can occur; and mixing said suspension of coalesced droplets with a sufficient amount of an extracting liquid to remove said dispersant from said coalesced droplets, wherein said extracting liquid is sufficiently miscible with said dispersant and present in sufficient volume to dissolve enough of said dispersant to cause said coalesced droplets to solidify and is selected from the group consisting of a liquid which is the same as said suspending liquid, a liquid miscible with said suspending liquid and exhibiting some mutual miscibility with said dispersant, and a solution of the suspending liquid and a cosolvent, said cosolvent being miscible with both said dispersant and said suspending liquid, whereby said droplets form substantially solidified particles having a controlled morphology and narrow size distribution.

2. The method according to claim 1, further comprising the step of isolating the substantially solidified particles from the suspension after said mixing.

3. The method according to claim 2, wherein said isolating is by filtration.

4. The method according to claim 1, wherein said extracting liquid and said suspending liquid are the same and have at least a 2 wt % mutual miscibility with said dispersant.

5. The method according to claim 1, wherein said extracting liquid is completely miscible with said suspending liquid and has at least a 2 wt % mutual miscibility with said dispersant.

6. The method according to claim 1, wherein said material is a hydrophobic material, said dispersant is substantially water-immiscible, and said suspending liquid is substantially immiscible with said dispersant.

7. The method according to claim 6, wherein said dispersant is ethyl acetate and said suspending liquid and said extracting liquid are water.

8. The method according to claim 1, wherein said material is a hydrophilic material, said dispersant is water or a substance more polar than said suspending liquid, and said suspending liquid is substantially immiscible with said dispersant.

9. The method according to claim 8, wherein said dispersant is water, said suspending liquid is benzyl alcohol, and said extracting liquid is a combination of benzyl alcohol and isopropyl alcohol.

10. The method according to claim 1, wherein said mixing is a single stage.

11. The method according to claim 1, wherein said mixing is by multiple stages.

12. The method according to claim 11, wherein said extracting liquid is the same for each of said multiple stages.

13. The method according to claim 12, wherein said extracting liquid is different in one or more of said multiple stages.

14. The method according to claim 1, wherein said mixing is continuous.

15. The method according to claim 1, further comprising the step of evaporating any of said dispersant which remains after said mixing.

16. The method according to claim 1, wherein said stabilizer is selected from the group consisting of latex-based copolymers and microgels.

17. The method according to claim 1, wherein said suspending liquid contains a promoter and said stabilizer is a silica stabilizer.

18. The method according to claim 1, wherein said material is a polymer suitable for use as a toner and is present in said dispersant in a concentration in the range from about 10 to about 35 wt %, and wherein said small droplets of said dispersion phase contain addenda selected from the group consisting of coloring agents and charge control agents.

19. The method according to claim 1, wherein said particles are suitable for use as electrographic carrier particles.

* * * * *